US006331218B1

(12) United States Patent
Inoue et al.

(10) Patent No.: US 6,331,218 B1
(45) **Date of Patent: *Dec. 18, 2001**

(54) HIGH STRENGTH AND HIGH RIGIDITY ALUMINUM-BASED ALLOY AND PRODUCTION METHOD THEREFOR

(75) Inventors: Akihisa Inoue, 11-806 Kawauchi-jutaku, Kawauchi, Aoba-ku, Sendai-shi, Miyagi-ken; Hisamichi Kimura, Watari-gun; Yuma Horio, Hamamatsu, all of (JP)

(73) Assignees: Tsuyoshi Masumoto; Akihisa Inoue, both of Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/162,747

(22) Filed: Sep. 29, 1998

Related U.S. Application Data

(60) Division of application No. 08/856,200, filed on May 14, 1997, now Pat. No. 5,858,131, which is a continuation-in-part of application No. 08/550,753, filed on Oct. 31, 1995, now abandoned.

(30) Foreign Application Priority Data

Nov. 2, 1994 (JP) ..... 6-270062

(51) Int. Cl.[7] ..... C22C 21/00
(52) U.S. Cl. ..... 148/561; 75/338; 164/46
(58) Field of Search ..... 164/46; 148/561; 75/338

(56) References Cited

U.S. PATENT DOCUMENTS 5,433,978 * 7/1995 Shield et al. ..... 75/338
5,858,131 * 1/1999 Inoue et al. ..... 148/403
6,017,403 * 1/2000 Masumoto et al. ..... 148/549

FOREIGN PATENT DOCUMENTS

710730 * 5/1996 (EP) .
693363 4/1994 (JP) .
6256875 9/1994 (JP) .

* cited by examiner

*Primary Examiner*—George Wyszomierski
(74) *Attorney, Agent, or Firm*—Ostrolenk, Faber, Gerb & Soffen, LLP

(57) ABSTRACT

An aluminum-based alloy having the general formula $Al_{100-(a+b)}Q_aM_b$ (wherein Q is V, Mo, Fe, W, Nb, and/or Pd; M is Mn, Fe, Co, Ni, and/or Cu; and a and b, representing a composition ratio in atomic percentages, satisfy the relationships $1 \leqq a \leqq 8$, $0<b<5$, and $3 \leqq a+b \leqq 8$) having a metallographic structure comprising a quasi-crystalline phase, wherein the difference in the atomic radii between Q and M exceeds 0.01 Å, and said alloy does not contain rare earths, possesses high strength and high rigidity. The aluminum-based alloy is useful as a structural material for aircraft, vehicles and ships, and for engine parts; as material for sashes, roofing materials, and exterior materials for use in construction; or as materials for use in marine equipment, nuclear reactors, and the like.

5 Claims, 6 Drawing Sheets

HIGH STRENGTH AND HIGH RIGIDITY ALUMINUM-BASED ALLOY AND PRODUCTION METHOD THEREFOR

CROSS-REFERENCE TO RELATED APPLICATION

This application is a Divisional of Ser. No.: 08/856,200, filed May 14, 1997, now U.S. Pat. No. 5,858,131 which is a continuation-in-part of application Ser. No. 08/550,753 filed on Oct. 31, 1995, now abandoned the subject matter of the above-mentioned application which is specifically incorporated by reference herein.

BACKGROUND OF THE INVENTION

1. Field of the Invention

The present invention relates to an aluminum-based alloy for use in a wide range of applications such as in a structural material for aircraft, vehicles, and ships, and for engine parts. In addition, the present invention may be employed in sashes, roofing materials, and exterior materials for use in construction, or as material for use in marine equipment, nuclear reactors, and the like.

2. Description of Related Art

As prior art aluminum-based alloys, alloys incorporating various components such as Al—Cu, Al—Si, Al—Mg, Al—Cu—Si, Al—Cu—Mg, and Al—Zn—Mg are known. In all of the aforementioned, superior anti-corrosive properties are obtained at a light weight, and thus the aforementioned alloys are being widely used as structural material for machines in vehicles, ships, and aircraft, in addition to being employed in sashes, roofing materials, exterior materials for use in construction, structural material for use in LNG tanks, and the like.

However, the prior art aluminum-based alloys generally exhibit disadvantages such as a low hardness and poor heat resistance when compared to material incorporating Fe. In addition, although some materials have incorporated elements such as Cu, Mg, and Zn for increased hardness, disadvantages remain such as low anti-corrosive properties.

On the other hand, recently, experiments have been conducted in which a fine metallographic structure of aluminum-based alloys is obtained by means of performing quick-quench solidification from a liquid-melt state, resulting in the production of superior mechanical strength and anti-corrosive properties.

In Japanese Patent Application, First Publication No. 1-275732, an aluminum-based alloy comprising a composition $AlM_1X$ with a special composition ratio (wherein $M_1$ represents an element such as V, Cr, Mn, Fe, Co, Ni, Cu, Zr and the like, and X represents a rare earth element such as La, Ce, Sm, and Nd, or an element such as Y, Nb, Ta, Mm (misch metal) and the like), and having an amorphous or a combined amorphous/fine crystalline structure, is disclosed.

This aluminum-based alloy can be utilized as material with a high hardness, high strength, high electrical resistance, anti-abrasion properties, or as soldering material. In addition, the disclosed aluminum-based alloy has a superior heat resistance, and may undergo extruding or press processing by utilizing the superplastic phenomenon observed near crystallization temperatures.

However, he aforementioned aluminum-based alloy is disadvantageous in that high costs result from the incorporation of large amounts of expensive rare earth elements and/or metal elements with a high activity such as Y. Namely, in addition to the aforementioned use of expensive raw materials, problems also arise such as increased consumption and labor costs due to the large scale of the manufacturing facilities required to treat materials with high activities. Furthermore, this aluminum-based alloy having the aforementioned composition tends to display insufficient resistance to oxidation and corrosion.

SUMMARY OF THE INVENTION

It is an object of the present invention to provide an aluminum-based alloy, possessing superior strength, rigidity, and anti-corrosive properties, which comprises a composition in which rare earth elements or high activity elements such as Y are not incorporated, thereby effectively reducing the cost, as well as, the activity described in the aforementioned.

In order to solve the aforementioned problems, the present invention provides a high strength and high rigidity aluminum-based alloy consisting essentially of a composition represented by the general formula $Al_{100-(a+b)}Q_aM_b$ (wherein Q is at least one metal: element selected from the group consisting of V, Mo, Fe, W, Nb, and Pd; M is at least one metal element selected from the group consisting of Mn, Fe, Co, Ni, and Cu; and a and b, which represent a composition ratio in atomic percentages, satisfy the relationships $1 \leqq a \leqq 8$, $0<b<5$, and $3 \leqq a+b \leqq 8$) having a metallographic structure comprising a quasi-crystalline phase, wherein the difference in the atomic radii between Q and M exceeds 0.01 Å, and said alloy does not contain rare earths.

According to the present invention, by adding a predetermined amount of V, Mo, Fe, W, Nb, and/or Pd to Al, the ability of the alloy to form a quasi-crystalline phase is improved, and the strength, hardness, and toughness of the alloy is also improved. Moreover, by adding a predetermined amount of Mn, Fe, Co, Ni, and/or Cu, the effects of quick-quenching are enhanced, the thermal stability of the overall metallographic structure is improved, and the strength and hardness of the resulting alloy are also increased. Fe has both quasi-crystalline phase forming effects and alloy strengthening effects.

The aluminum-based alloy according to the present invention is useful as materials with a high hardness, strength, and rigidity. Furthermore, this alloy also stands up well to bending, and thus possesses superior properties such as the ability to be mechanically processed.

Accordingly, the aluminum-based alloys according to the present invention can be used in a wide range of applications such as in the structural material for aircraft, vehicles, and ships, as well as for engine parts. In addition, the aluminum-based alloys of the present invention may be employed in sashes, roofing materials, and exterior materials for use in construction, or as materials for use in marine equipment, nuclear reactors, and the like.

DETAILED DESCRIPTION OF THE PREFERRED EMBODIMENTS

Figure 1:
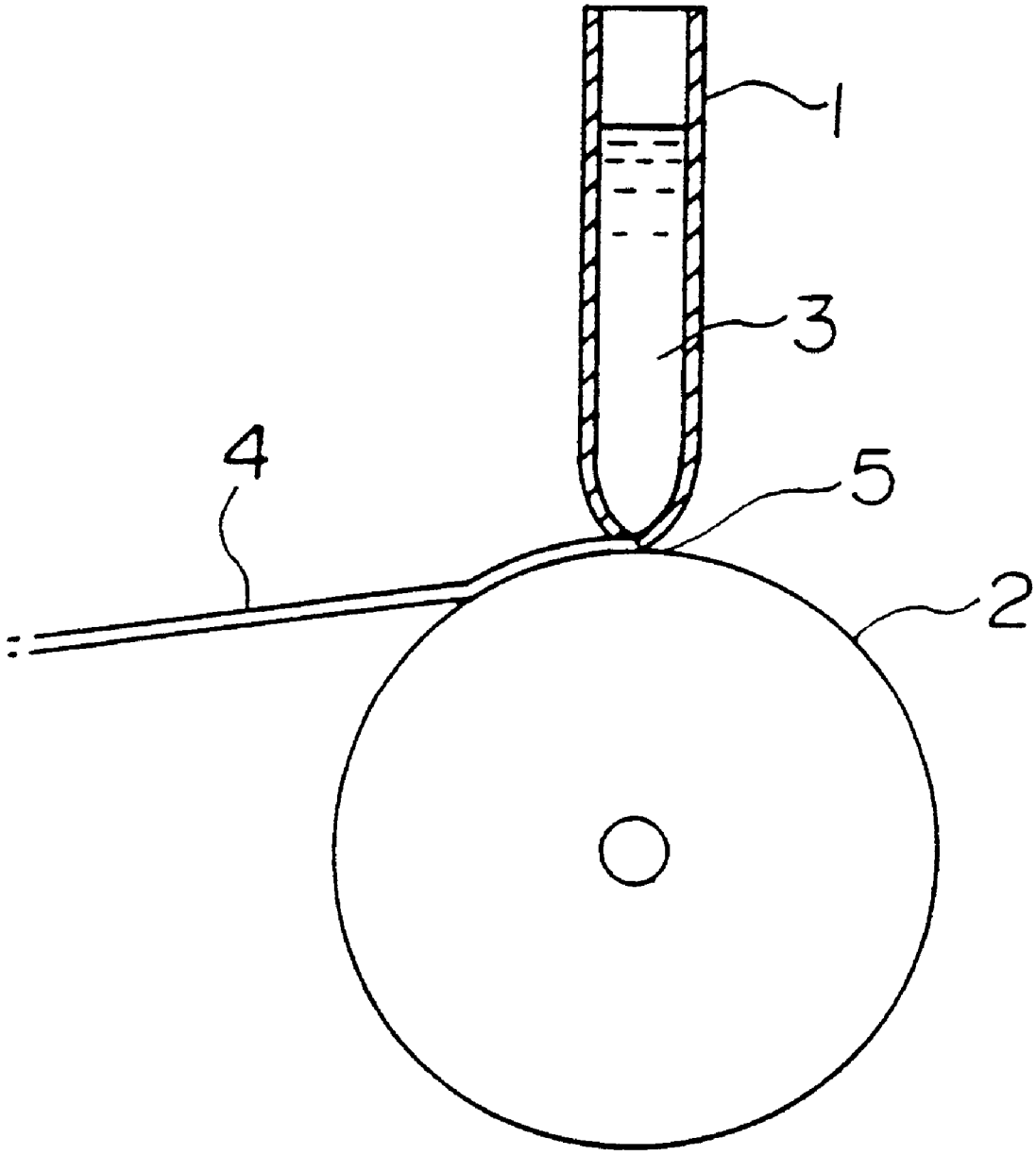
FIG. 1 shows a construction of an example of a single roll apparatus used at the time of manufacturing a tape of an alloy of the present invention following quick-quench solidification.

The preferred embodiment of the present invention provides a high strength and high rigidity aluminum-based alloy consisting essentially of a composition represented by the general formula $Al_{100-(a+b)}Q_aM_b$ (wherein Q is at least one metal element selected from the group consisting of V, Mo, Fe, W, Nb, and Pd; M is at least one metal element selected from the group consisting of Mn, Fe, Co, Ni, and Cu; and a and b, which represent a composition ratio in atomic percentages, satisfy the relationships $1 \leqq a \leqq 8$, $0<b<5$, and $3 \leqq a+b \leqq 8$), comprising a quasi-crystalline phase in the alloy, wherein the difference in the atomic radii between Q and M exceeds 0.01 Å, and said alloy does not contain rare earths.

In the following, the reasons for limiting the composition ratio of each component in the alloy according to the present invention are explained.

The atomic percentage of Al (aluminum) is in the range of $92 \leqq Al \leqq 97$, preferably in the range of $94 \leqq Al \leqq 97$. An atomic percentage for Al of less than 92% results in embrittlement of the alloy. On the other hand, an atomic percentage for Al exceeding 97% results in reduction of the strength and hardness of the alloy.

The amount of at least one metal element selected from the group consisting of V (vanadium), Mo (molybdenum), Fe (iron), W (tungsten), Nb (niobium), and Pd (palladium) in atomic percentage is at least 1% and does not exceed 84%; preferably, the amount is at least 2% and does not exceed 8%; more preferably, the amount is at least 2% and does not exceed 6%. If the amount is less than 1%, a quasi-crystalline phase cannot be obtained, and the strength is markedly reduced. On the other hand, if the amount exceeds 10%, coarsening (the diameter of particles is 500 nm or more) of a quasi-crystalline phase occurs, and this results in remarkable embrittlement of the alloy and reduction of (rupture) strength of the alloy.

The amount of at least one metal element selected from the group consisting of Mn (manganese), Fe (iron), Co (cobalt), Ni (nickel), and Cu (copper) in atomic percentage is less than 5%; preferably, the amount is at least 1% and does not exceed 3%; more preferably, the amount is at least 1% and does not exceed 2%. If the amount is 5% or more, forming and coarsening (the diameter of particles is 500 nm or more) of intermetallic compounds occur, and these result in remarkable embrittlement and reduction of toughness of the alloy.

Furthermore, with the present invention, the difference in radii between the atom selected from the above-mentioned group Q and the atom selected from the above-mentioned group M must exceed 0.01 Å. According to the Metals Databook (Nippon Metals Society Edition, 1984, published by Maruzen K. K.), the radii of the atoms contained in groups Q and M are as follows, and the differences in atmic radii for each combination are as shown in Table 1.

Q: V=1.32 Å, Mo=1.36 Å, Fe=1.24 Å, W=1.37 Å, Nb=1.43 Å, Pd=1.37 Å

M: Mn=1.12 Å or 1.50 Å, Fe=1.24 Å, Ni=1.25 Å, Co=1.25 Å, Cu=1.28 Å

Table 1 shows the differences in radii between atoms selected from group Q and atoms selected from group M for all combinations, as calculated from the above-listed atomic radius values.

TABLE 1

| | Units: Å | | | | |
|---|---|---|---|---|---|
| ELEMENT | Mn | Fe | Co | Ni | Cu |
| V | 0.20 0r 0.18 | 0.08 | 0.07 | 0.07 | 0.04 |
| Nb | 0.31 0r 0.07 | 0.19 | 0.18 | 0.18 | 0.15 |
| Mo | 0.24 0r 0.14 | 0.12 | 0.11 | 0.11 | 0.08 |
| Pd | 0.25 0r 0.13 | 0.13 | 0.12 | 0.12 | 0.09 |
| W | 0.25 0r 0.13 | 0.13 | 0.12 | 0.12 | 0.09 |
| Fe | 0.12 0r 0.26 | 0 | 0.01 | 0.01 | 0.04 |

Therefore, of the combinations of Q and M expressed by the above-given general formula, the three combinations of:

Q=Fe, M=Fe

Q=Fe, M=Co

Q=Fe, M=Ni are excluded from the scope of the present invention.

If the difference in radii of the atom selected from group Q and the atom selected from group M is not more than 0.01 Å, then they tend to form thermodynamically stable intermetallic compounds which are undesirable for tending to become brittle upon solidification. For example, when forming bulk-shaped samples by solidifying ultra-quick-quenching tape, the intermetallic compounds leave prominent deposits so as to make the samples extremely brittle.

The formation of thermodynamically stable intermetallic compounds can be detected, for example, as decreases in the crystallization temperature by means of differential scanning calorimetry (DSC).

Additionally, brittleness can appear as reductions in the Charpy impact values.

Furthermore, the total amount of unavoidable impurities, such as Fe, Si, Cu, Zn, Ti, O, C, or N, does not exceed 0.3% by weight; preferably, the amount does not exceed 0.15% by weight; and more preferably, the amount does not exceed 0.10% by weight. If the amount exceeds 0.3% by weight, the effects of quick-quenching is lowered, and this results in reduction of the formability of a quasi-crystalline phase. Among the unavoidable impurities, particularly, it is preferable that the amount of O does not exceed 0.1% by weight and that the amount of C or N does not exceed 0.03% by weight.

The aforementioned aluminum-based alloys can be manufactured by quick-quench solidification of the alloy liquid-melts having the aforementioned compositions using a liquid quick-quenching method. This liquid quick-quenching method essentially entails rapid cooling of the melted alloy. For example, single roll, double roll, and submerged rotational spin methods have proved to be particularly effective. In these aforementioned methods, a cooling rate of $10^4$ to $10^6$ K/sec is easily obtainable.

In order to manufacture a thin tape using the aforementioned single or double roll methods, the liquid-melt is first poured into a storage vessel such as a silica tube, and is then discharged, via a nozzle aperture at the tip of the silica tube, towards a copper or copper alloy roll of diameter 30 to 300 mm, which is rotating at a fixed velocity in the range of 300 to 1000 rpm. In this manner, various types of thin tapes of thickness 5–500 μm and width 1–300 mm can be easily obtained.

On the other hand, fine wire-thin material can be easily obtained through the submerged rotational spin method by discharging the liquid-melt via the nozzle aperture, into a refrigerant solution layer of depth 1 to 10 cm, maintained by means of centrifugal force inside an air drum rotating at 50 to 500 rpm, under argon gas back pressure. In this case, the angle between the liquid-melt discharged from the nozzle, and the refrigerant surface is preferably 60 to 90 degrees, and the relative velocity ratio of the liquid-melt and the refrigerant surface is preferably 0.7 to 0.9.

In addition, thin layers of aluminum-based alloy of the aforementioned compositions can also be obtained without using the above methods, by employing layer formation processes such as the sputtering method. In addition, aluminum alloy powder of the aforementioned compositions can be obtained by quick-quenching the liquid-melt using various atomizer and spray methods such as a high pressure gas spray method.

In the following, examples of metallographic-structural states of the aluminum-based alloy obtained using the aforementioned methods are listed:

(1) Multiphase structure incorporating a quasi-crystalline phase and an aluminum phase;

(2) Multiphase structure incorporating a quasi-crystalline phase and a metal solid solution having an aluminum matrix;

(3) Multiphase structure incorporating a quasi-crystalline phase and a stable or metastable intermetallic compound phase; and (4) Multiphase structure incorporating a quasi-crystalline phase, an amorphous phase, and a metal solid solution having an aluminum matrix.

The fine crystalline phase of the present invention represents a crystalline phase in which the crystal particles have an average maximum diameter of 1 μm.

By regulating the cooling rate of the alloy liquid-melt, any of the metallographic-structural states described in (1) to (4) above can be obtained.

The properties of the alloys possessing the aforementioned metallographic-structural states are described in the following.

An alloy of the multiphase structural state described in (1) and (2) above has a high strength and an excellent bending ductility.

An alloy of the multiphase structural state described in (3) above has a higher strength and lower ductility than the alloys of the multiphase structural state described in (1) and (2). However, the lower ductility does not hinder its high strength.

An alloy of the multiphase structural state described in (4) has a high strength, high toughness and a high ductility.

Each of the aforementioned metallographic-structural states can be easily determined by a normal X-ray diffraction method or by observation using a transmission electron microscope. In the case when a quasi-crystal exists, a dull peak, which is characteristic of a quasi-crystalline phase, is exhibited.

By regulating the cooling rate of the alloy liquid-melt, any of the multiphase structural states described in (1) to (3) above can be obtained.

By quick-quenching the alloy liquid-melt of the Al-rich composition (e.g., composition with Al≧92 atomic %), any of the metallographic-structural states described in (4) can be obtained.

The aluminum-based alloy of the present invention displays superplasticity at temperatures near the crystallization temperature (crystallization temperature ±50° C.), as well as, at the high temperatures within the fine crystalline stable temperature range, and thus processes such as extruding, pressing, and hot forging can easily be performed. Consequently, aluminum-based alloys of the above-mentioned compositions obtained in the aforementioned thin tape, wire, plate, and/or powder states can be easily formed into bulk materials by means of extruding, pressing and hot forging processes at the aforementioned temperatures. Furthermore, the aluminum-based alloys of the aforementioned compositions possess a high ductility, thus bending of 180° is also possible.

Additionally, the aforementioned aluminum-based alloys having multiphase structure composed of a pure-aluminum phase, a quasi-crystalline phase, a metal solid solution, and/or an amorphous phase, and the like, do not display structural or chemical non-uniformity of crystal grain boundary, segregation and the like, as seen in crystalline alloys. These alloys cause passivation due to formation of an aluminum oxide layer, and thus display a high resistance to corrosion. Furthermore, disadvantages exist when incorporating rare earth elements: due to the activity of these rare earth elements, non-uniformity occurs easily in the passive layer on the alloy surface resulting in the progress of corrosion from this portion towards the interior. However, since the alloys of the aforementioned compositions do not incorporate rare earth elements, these aforementioned problems are effectively circumvented.

In regards to the aluminum-based alloy of the aforementioned compositions, the manufacturing of bulk-shaped (mass) material will now be explained.

When heating the aluminum-based alloy according to the present invention, precipitation and crystallization of the fine crystalline phase is accompanied by precipitation of the aluminum matrix (α-phase), and when further heating beyond this temperature, the intermetallic compound also precipitates. Utilizing this property, bulk material possessing a high strength and ductility can be obtained.

Concretely, the tape alloy manufactured by means of the aforementioned quick-quenching process is pulverized in a ball mill, and then powder pressed in a vacuum hot press under vacuum (e.g. $10^{-3}$ Torr) at a temperature slightly below the crystallization temperature (e.g. approximately 470K), thereby forming a billet for use in extruding with a diameter and length of several centimeters. This billet is set inside a container of an extruder, and is maintained at a temperature slightly greater than the crystallization temperature for several tens of minutes. Extruded materials can then be obtained in desired shapes such as round bars, etc., by extruding.

EXAMPLES (Hardness and Tensile Rupture Strength)

A molten alloy having a predetermined composition was manufactured using a high frequency melting furnace. Then, as shown in FIG. 1, this melt was poured into a silica tube 1 with a small aperture 5 (aperture diameter: 0.2 to 0.5 mm) at the tip, and then heated to melt, after which the aforementioned silica tube 1 was positioned directly above copper roll 2. This roll 2 was then rotated at a high speed of 4000 rpm, and argon gas pressure (0.7 kg/cm$^3$) was applied to silica tube 1. Quick-quench solidification was subsequently performed by quick-quenching the liquid-melt by means of discharging the liquid-melt from small aperture 5 of silica tube 1 onto the surface of roll 2 and quick-quenching to yield an alloy tape 4.

Under these manufacturing conditions, the numerous alloy tape samples (width: 1 mm, thickness: 20 $\mu$m) of the compositions (atomic percentages) shown in Tables 2 and 3 were formed. The hardness (Hv) and tensile rupture strength ($\sigma_f$: MPa) of each alloy tape sample were measured. These results are also shown in Tables 2 and 3. The hardness is expressed in the value measured according to the minute Vickers hardness scale (DPN: Diamond Pyramid Number).

Additionally, a 180° contact bending test was conducted by bending each sample 180° and contacting the ends thereby forming a U-shape. The results of these tests are also shown in Tables 2 and 3: those samples which displayed ductility and did not rupture are designated Duc (ductile), while those which ruptured are designated Bri (brittle).

TABLE 2

| Sample No. | Alloy composition (at %) | σf (MPa) | Hv (DPN) | Bending test | |
|---|---|---|---|---|---|
| 1 | $Al_{95}V_3Ni_2$ | 880 | 320 | Duc | Example |
| 2 | $Al_{94}V_4Ni_2$ | 1230 | 365 | Duc | Example |
| 3 | $Al_{93}V_5Ni_2$ | 1060 | 325 | Duc | Example |
| 4 | $Al_{95}V_3Fe_2$ | 630 | 300 | Duc | Example |
| 5 | $Al_{94}V_4Fe_2$ | 1350 | 370 | Duc | Example |
| 6 | $Al_{93}V_5Fe_2$ | 790 | 305 | Duc | Example |
| 7 | $Al_{95}V_3Co_2$ | 840 | 310 | Duc | Example |
| 8 | $Al_{94}V_4Co_2$ | 1230 | 355 | Duc | Example |
| 9 | $Al_{93}V_5Co_2$ | 1090 | 350 | Duc | Example |
| 10 | $Al_{94}V_4Mn_2$ | 1210 | 355 | Duc | Example |
| 11 | $Al_{93}V_4Mn_3$ | 800 | 310 | Duc | Example |
| 12 | $Al_{94}V_4Cu_2$ | 1010 | 310 | Duc | Example |
| 14 | $Al_{92}V_5Ni_3$ | 1110 | 330 | Duc | Example |
| 15 | $Al_{93}V_4Fe_3$ | 1200 | 340 | Duc | Example |
| 16 | $Al_{93}V_6Fe_1$ | 1210 | 345 | Duc | Example |
| 17 | $Al_{92}V_7Co_1$ | 1010 | 310 | Duc | Example |
| 18 | $Al_{93}V_4Co_3$ | 1110 | 310 | Duc | Example |
| 19 | $Al_{94}Mo_4Ni_2$ | 1200 | 300 | Duc | Example |
| 20 | $Al_{95}Mo_3Ni_2$ | 1250 | 305 | Duc | Example |
| 21 | $Al_{93}Mo_5Ni_2$ | 1300 | 320 | Duc | Example |
| 22 | $Al_{94}Mo_4Co_2$ | 1010 | 300 | Duc | Example |
| 23 | $Al_{95}Mo_3Co_2$ | 1210 | 330 | Duc | Example |
| 24 | $Al_{93}Mo_5Fe_2$ | 990 | 310 | Duc | Example |
| 25 | $Al_{94}Mo_4Fe_2$ | 1320 | 375 | Duc | Example |
| 26 | $Al_{94}Mo_4Mn_2$ | 1220 | 360 | Duc | Example |
| 27 | $Al_{92}Mo_5Mn_3$ | 1100 | 345 | Duc | Example |
| 28 | $Al_{95}Mo_3Mn_2$ | 1020 | 330 | Duc | Example |
| 29 | $Al_{97}Mo_1Cu_2$ | 880 | 305 | Duc | Example |
| 30 | $Al_{94}Fe_4Mn_2$ | 1320 | 370 | Duc | Example |
| 31 | $Al_{94}Fe_3Mn_3$ | 1100 | 345 | Duc | Example |
| 33 | $Al_{94}Fe_4Cu_2$ | 890 | 285 | Duc | Example |
| 34 | $Al_{95}Fe_4Cu_1$ | 880 | 300 | Duc | Example |
| 35 | $Al_{94}W_4Ni_2$ | 1010 | 340 | Duc | Example |
| 36 | $Al_{94}W_3Ni_3$ | 1000 | 300 | Duc | Example |
| 37 | $Al_{93}W_5Co_2$ | 1110 | 315 | Duc | Example |
| 38 | $Al_{95}W_2Co_3$ | 1210 | 365 | Duc | Example |
| 39 | $Al_{94}W_4Fe_2$ | 1090 | 305 | Duc | Example |
| 40 | $Al_{93}W_6Fe_1$ | 1100 | 360 | Duc | Example |
| 41 | $Al_{94}W_2Mn_4$ | 1210 | 350 | Duc | Example |
| 42 | $Al_{92}Nb_6Mn_2$ | 1230 | 330 | Duc | Example |
| 43 | $Al_{94}Nb_4Fe_2$ | 1040 | 320 | Duc | Example |
| 44 | $Al_{94}Nb_4Ni_2$ | 1300 | 370 | Duc | Example |
| 45 | $Al_{93}Nb_3Ni_4$ | 1210 | 360 | Duc | Example |
| 46 | $Al_{95}Nb_3Ni_2$ | 1100 | 360 | Duc | Example |
| 47 | $Al_{94}Nb_4Co_2$ | 1150 | 365 | Duc | Example |
| 50 | $Al_{94}Pd_4Fe_2$ | 1010 | 315 | Duc | Example |
| 51 | $Al_{96}Pd_3Fe_1$ | 990 | 310 | Duc | Example |
| 52 | $Al_{94}Pd_4Ni_2$ | 1210 | 365 | Duc | Example |
| 53 | $Al_{92}Pd_5Ni_3$ | 1230 | 365 | Duc | Example |
| 54 | $Al_{94}Pd_3Co_3$ | 1100 | 335 | Duc | Example |

TABLE 3

| Sample No. | Alloy composition (at %) | σf (MPa) | Hv (DPN) | Bending test | |
|---|---|---|---|---|---|
| 55 | $Al_{94}Fe_4Co_2$ | 1310 | 370 | Duc | Comparative Example |
| 56 | $Al_{94}Fe_5Co_1$ | 1110 | 335 | Duc | Comparative Example |
| 57 | $Al_{96}Fe_3Co_1$ | 1010 | 320 | Duc | Comparative Example |
| 58 | $Al_{90}Fe_8Ni_2$ | 1100 | 340 | Duc | Comparative Example |
| 59 | $Al_{88}Fe_{10}Ni_2$ | 1300 | 375 | Duc | Comparative Example |
| 60 | $Al_{88}Fe_9Ni_3$ | 1280 | 360 | Duc | Comparative Example |
| 61 | $Al_{96.5}V_{0.5}Mn_3$ | 460 | 95 | Duc | Comparative Example |
| 62 | $Al_{86}V_{12}Mn_2$ | 600 | 450 | Bri | Comparative Example |
| 63 | $Al_{97}V_3$ | 400 | 120 | Duc | Comparative Example |
| 64 | $Al_{90}V_4Mn_6$ | 550 | 410 | Bri | Comparative Example |
| 65 | $Al_{98}V_1Mn_1$ | 430 | 95 | Duc | Comparative Example |
| 66 | $Al_{87}V_{10}Mn_3$ | 510 | 410 | Bri | Comparative Example |
| 67 | $Al_{96.5}V_{0.5}Fe_3$ | 410 | 120 | Duc | Comparative Example |
| 68 | $Al_{85}V_{13}Fe_2$ | 505 | 405 | Bri | Comparative Example |
| 69 | $Al_{98}V_1Fe_1$ | 400 | 110 | Duc | Comparative Example |
| 70 | $Al_{87}V_{10}Fe_3$ | 490 | 410 | Bri | Comparative Example |
| 71 | $Al_{90}V_4Fe_6$ | 450 | 430 | Bri | Comparative Example |
| 72 | $Al_{95.5}V_{0.5}Ni_4$ | 390 | 95 | Duc | Comparative Example |
| 73 | $Al_{86}V_{11}Ni_3$ | 410 | 430 | Bri | Comparative Example |
| 74 | $Al_{89}V_4Ni_7$ | 405 | 425 | Bri | Comparative Example |
| 75 | $Al_{98}V_1Ni_1$ | 290 | 80 | Duc | Comparative Example |
| 76 | $Al_{85}V_{11}Ni_4$ | 500 | 420 | Bri | Comparative Example |
| 77 | $Al_{94.5}V_{0.5}Co_5$ | 410 | 125 | Duc | Comparative Example |
| 78 | $Al_{83}V_{15}Co_2$ | 490 | 480 | Bri | Comparative Example |
| 79 | $Al_{90}V_2Co_8$ | 480 | 410 | Bri | Comparative Example |
| 80 | $Al_{98.5}V_{0.5}Co_1$ | 210 | 90 | Duc | Comparative Example |
| 81 | $Al_{85}V_{11}Co_4$ | 410 | 430 | Bri | Comparative Example |
| 82 | $Al_{94.5}V_{0.5}Cu_5$ | 340 | 105 | Duc | Comparative Example |
| 83 | $Al_{88}V_{11}Cu_1$ | 490 | 420 | Bri | Comparative Example |
| 84 | $Al_{89}V_3Cu_8$ | 480 | 410 | Bri | Comparative Example |
| 85 | $Al_{98}V_1Cu_1$ | 410 | 95 | Duc | Comparative Example |
| 86 | $Al_{85}V_{12}Cu_3$ | 550 | 420 | Bri | Comparative Example |
| 87 | $Al_{96.5}Mo_{0.5}Mn_3$ | 430 | 125 | Duc | Comparative Example |
| 88 | $Al_{86}Mo_{12}Mn_2$ | 510 | 430 | Bri | Comparative Example |
| 89 | $Al_{97}Mo_3$ | 370 | 130 | Duc | Comparative Example |
| 90 | $Al_{90}Mo_4Mn_6$ | 480 | 410 | Bri | Comparative Example |
| 91 | $Al_{98}Mo_1Mn_1$ | 380 | 100 | Duc | Comparative Example |

TABLE 3-continued

| Sample No. | Alloy composition (at %) | σf (MPa) | Hv (DPN) | Bending test | |
|---|---|---|---|---|---|
| 92 | $Al_{87}Mo_{10}Mn_3$ | 490 | 420 | Bri | Comparative Example |
| 93 | $Al_{96.5}Mo_{0.5}Fe_3$ | 360 | 125 | Duc | Comparative Example |
| 94 | $Al_{85}Mo_{13}Fe_2$ | 500 | 460 | Bri | Comparative Example |
| 95 | $Al_{98}Mo_1Fe_1$ | 210 | 80 | Duc | Comparative Example |
| 96 | $Al_{87}Mo_{10}Fe_3$ | 510 | 450 | Bri | Comparative Example |
| 97 | $Al_{90}Mo_4Fe_6$ | 490 | 435 | Bri | Comparative Example |
| 98 | $Al_{95.5}Mo_{0.5}Ni_4$ | 310 | 95 | Duc | Comparative Example |
| 99 | $Al_{86}Mo_{11}Ni_3$ | 500 | 430 | Bri | Comparative Example |
| 100 | $Al_{89}Mo_4Ni_7$ | 465 | 410 | Bri | Comparative Example |
| 101 | $Al_{98}Mo_1Ni_1$ | 200 | 95 | Duc | Comparative Example |
| 102 | $Al_{85}Mo_{11}Ni_4$ | 460 | 450 | Bri | Comparative Example |
| 103 | $Al_{94.5}Mo_{0.5}Co_5$ | 380 | 100 | Duc | Comparative Example |
| 104 | $Al_{83}Mo_{15}Co_2$ | 510 | 410 | Bri | Comparative Example |
| 105 | $Al_{90}Mo_2Co_8$ | 490 | 420 | Bri | Comparative Example |
| 106 | $Al_{98.5}Mo_{0.5}Co_1$ | 360 | 105 | Duc | Comparative Example |
| 107 | $Al_{85}Mo_{11}Co_4$ | 460 | 430 | Bri | Comparative Example |
| 108 | $Al_{94.5}Mo_{0.5}Cu_5$ | 340 | 105 | Duc | Comparative Example |
| 109 | $Al_{88}Mo_{11}Cu_1$ | 490 | 430 | Bri | Comparative Example |
| 110 | $Al_{89}Mo_3Cu_8$ | 510 | 410 | Bri | Comparative Example |
| 111 | $Al_{98}Mo_1Cu_1$ | 410 | 95 | Duc | Comparative Example |
| 112 | $Al_{85}Mo_{12}Cu_3$ | 550 | 420 | Bri | Comparative Example |
| 113 | $Al_{96.5}Fe_{0.5}Mn_3$ | 420 | 130 | Duc | Comparative Example |
| 114 | $Al_{86}Fe_{12}Mn_2$ | 510 | 430 | Bri | Comparative Example |
| 115 | $Al_{97}Fe_3$ | 480 | 160 | Duc | Comparative Example |
| 116 | $Al_{90}Fe_4Mn_6$ | 530 | 425 | Bri | Comparative Example |
| 117 | $Al_{98}Fe_1Mn_1$ | 480 | 95 | Duc | Comparative Example |
| 118 | $Al_{87}Fe_{10}Mn_3$ | 510 | 420 | Bri | Comparative Example |
| 119 | $Al_{95.5}Fe_{0.5}Ni_4$ | 470 | 105 | Duc | Comparative Example |
| 120 | $Al_{86}Fe_{11}Ni_3$ | 510 | 420 | Bri | Comparative Example |
| 121 | $Al_{89}Fe_4Ni_7$ | 505 | 425 | Bri | Comparative Example |
| 122 | $Al_{98}Fe_1Ni_1$ | 380 | 95 | Duc | Comparative Example |
| 123 | $Al_{85}Fe_{11}Ni_4$ | 500 | 410 | Bri | Comparative Example |
| 124 | $Al_{94.5}Fe_{0.5}Co_5$ | 380 | 125 | Duc | Comparative Example |
| 125 | $Al_{83}Fe_{15}Co_2$ | 200 | 480 | Bri | Comparative Example |
| 126 | $Al_{90}Fe_2Co_8$ | 490 | 425 | Bri | Comparative Example |
| 127 | $Al_{98.5}Fe_{0.5}Co_1$ | 380 | 95 | Duc | Comparative Example |
| 128 | $Al_{85}Fe_{11}Co_4$ | 350 | 435 | Bri | Comparative Example |

TABLE 3-continued

| Sample No. | Alloy composition (at %) | σf (MPa) | Hv (DPN) | Bending test | |
|---|---|---|---|---|---|
| 129 | $Al_{94.5}Fe_{0.5}Cu_5$ | 340 | 105 | Duc | Comparative Example |
| 130 | $Al_{88}Fe_{11}Cu_1$ | 410 | 435 | Bri | Comparative Example |
| 131 | $Al_{89}Fe_3Cu_8$ | 480 | 410 | Bri | Comparative Example |
| 132 | $Al_{98}Fe_1Cu_1$ | 410 | 95 | Duc | Comparative Example |
| 133 | $AL_{85}Fe_{12}Cu_3$ | 550 | 420 | Bri | Comparative Example |
| 134 | $Al_{96.5}W_{0.5}Mn_3$ | 380 | 120 | Duc | Comparative Example |
| 135 | $Al_{86}W_{12}Mn_2$ | 420 | 435 | Bri | Comparative Example |
| 136 | $Al_{97}W_3$ | 280 | 95 | Duc | Comparative Example |
| 137 | $Al_{90}W_4Mn_6$ | 490 | 440 | Bri | Comparative Example |
| 138 | $Al_{98}W_1Mn_1$ | 280 | 95 | Duc | Comparative Example |
| 139 | $Al_{87}W_{10}Mn_3$ | 290 | 475 | Bri | Comparative Example |
| 140 | $Al_{96.5}W_{0.5}Fe_3$ | 385 | 105 | DUC | Comparative Example |
| 141 | $Al_{85}W_{13}Fe_2$ | 310 | 480 | Bri | Comparative Example |
| 142 | $Al_{98}W_1Fe_1$ | 320 | 105 | Duc | Comparative Example |
| 143 | $Al_{87}W_{10}Fe_3$ | 500 | 475 | Bri | Comparative Example |
| 144 | $Al_{90}W_4Fe_6$ | 510 | 460 | Bri | Comparative Example |
| 145 | $Al_{95.5}W_{0.5}Ni_4$ | 380 | 95 | Duc | Comparative Example |
| 146 | $Al_{86}W_{11}Ni_{13}$ | 520 | 470 | Bri | Comparative Example |
| 147 | $Al_{89}W_4Ni_7$ | 500 | 435 | Bri | Comparative Example |
| 148 | $Al_{98}W_1Ni_1$ | 280 | 80 | Duc | Comparative Example |
| 149 | $Al_{85}W_{11}Ni_4$ | 460 | 435 | Bri | Comparative Example |
| 150 | $Al_{94.5}W_{0.5}Co_5$ | 275 | 105 | Duc | Comparative Example |
| 151 | $Al_{83}W_{15}Co_2$ | 500 | 460 | Bri | Comparative Example |
| 152 | $Al_{90}W_2Co_8$ | 410 | 445 | Bri | Comparative Example |
| 153 | $Al_{98.5}W_{0.5}Co_1$ | 270 | 85 | Duc | Comparative Example |
| 184 | $Al_{85}W_{11}Co_4$ | 290 | 470 | Bri | Comparative Example |
| 155 | $Al_{94.5}W_{0.5}Cu_5$ | 340 | 105 | Duc | Comparative Example |
| 156 | $Al_{88}W_{11}Cu_1$ | 310 | 435 | Bri | Comparative Example |
| 157 | $Al_{89}W_3Cu_8$ | 380 | 410 | Bri | Comparative Example |
| 158 | $Al_{98}W_1Cu_1$ | 410 | 95 | Duc | Comparative Example |
| 159 | $Al_{85}W_{12}Cu_3$ | 550 | 420 | Bri | Comparative Example |
| 160 | $Al_{96.5}Nb_{0.5}Mn_3$ | 430 | 120 | Duc | Comparative Example |
| 161 | $Al_{86}Nb_{12}Mn_2$ | 510 | 475 | Bri | Comparative Example |
| 162 | $Al_{97}Nb_3$ | 430 | 105 | Duc | Comparative Example |
| 163 | $Al_{90}Nb_4Mn_6$ | 490 | 430 | Bri | Comparative Example |
| 164 | $Al_{98}Nb_1Mn_1$ | 380 | 95 | Duc | Comparative Example |
| 165 | $Al_{87}Nb_{10}Mn_3$ | 390 | 465 | Bri | Comparative Example |

TABLE 3-continued

| Sample No. | Alloy composition (at %) | σf (MPa) | Hv (DPN) | Bending test | |
|---|---|---|---|---|---|
| 166 | $Al_{96.5}Nb_{0.5}Fe_3$ | 400 | 95 | Duc | Comparative Example |
| 167 | $Al_{85}Nb_{13}Fe_2$ | 390 | 480 | Bri | Comparative Example |
| 168 | $Al_{98}Nb_1Fe_1$ | 430 | 100 | Duc | Comparative Example |
| 169 | $Al_{87}Nb_{10}Fe_3$ | 510 | 435 | Bri | Comparative Example |
| 170 | $Al_{90}Nb_4Fe_6$ | 420 | 80 | Bri | Comparative Example |
| 171 | $Al_{95.5}Nb_{0.5}Ni_4$ | 380 | 110 | Duc | Comparative Example |
| 172 | $Al_{86}Nb_{11}Ni_3$ | 510 | 440 | Bri | Comparative Example |
| 173 | $Al_{89}Nb_4Ni_7$ | 490 | 435 | Bri | Comparative Example |
| 174 | $Al_{98}Nb_1Ni_1$ | 230 | 80 | Duc | Comparative Example |
| 175 | $Al_{85}Nb_{11}Ni_4$ | 430 | 475 | Bri | Comparative Example |
| 176 | $Al_{94.5}Nb_{0.5}Co_5$ | 280 | 95 | Duc | Comparative Example |
| 177 | $Al_{83}Nb_{15}Co_2$ | 410 | 470 | Bri | Comparative Example |
| 178 | $Al_{90}Nb_2Co_8$ | 510 | 430 | Bri | Comparative Example |
| 179 | $Al_{98.5}Nb_{0.5}Co_1$ | 270 | 90 | Duc | Comparative Example |
| 180 | $Al_{85}Nb_{11}Co_4$ | 510 | 475 | Bri | Comparative Example |
| 181 | $Al_{94.5}Nb_{0.5}Cu_5$ | 340 | 105 | Duc | Comparative Example |
| 182 | $Al_{88}Nb_{11}Cu_1$ | 490 | 445 | Bri | Comparative Example |
| 183 | $Al_{89}Nb_3Cu_8$ | 475 | 410 | Bri | Comparative Example |
| 184 | $Al_{98}Nb_1Cu_1$ | 410 | 95 | Duc | Comparative Example |
| 185 | $Al_{85}Nb_{12}Cu_3$ | 550 | 420 | Bri | Comparative Example |
| 186 | $Al_{96.5}Pd_{0.5}Mn_3$ | 380 | 105 | Duc | Comparative Example |
| 187 | $Al_{86}Pd_{12}Mn_2$ | 400 | 435 | Bri | Comparative Example |
| 188 | $Al_{97}Pd_3$ | 410 | 95 | Duc | Comparative Example |
| 189 | $Al_{90}Pd_4Mn_6$ | 510 | 420 | Bri | Comparative Example |
| 190 | $Al_{98}Pd_1Mn_1$ | 390 | 80 | Duc | Comparative Example |
| 191 | $Al_{87}Pd_{10}Mn_3$ | 490 | 465 | Bri | Comparative Example |
| 192 | $Al_{96.5}Pd_{0.5}Fe_3$ | 300 | 95 | Duc | Comparative Example |
| 193 | $Al_{85}Pd_{13}Fe_2$ | 210 | 480 | Bri | Comparative Example |
| 194 | $Al_{98}Pd_1Fe_1$ | 290 | 105 | Duc | Comparative Example |
| 195 | $Al_{87}Pd_{10}Fe_3$ | 460 | 435 | Bri | Comparative Example |
| 196 | $Al_{90}Pd_4Fe_6$ | 475 | 430 | Bri | Comparative Example |
| 197 | $Al_{95.5}Pd_{0.5}Ni_4$ | 310 | 90 | Duc | Comparative Example |
| 198 | $Al_{86}Pd_{11}Ni_3$ | 410 | 465 | Bri | Comparative Example |
| 199 | $Al_{89}Pd_4Ni_7$ | 460 | 450 | Bri | Comparative Example |
| 200 | $Al_{98}Pd_1Ni_1$ | 280 | 85 | Duc | Comparative Example |
| 201 | $Al_{85}Pd_{11}Ni_4$ | 410 | 460 | Bri | Comparative Example |
| 202 | $Al_{94.5}Pd_{0.5}Co_5$ | 430 | 120 | Duc | Comparative Example |
| 203 | $Al_{83}Pd_{15}Co_2$ | 290 | 485 | Bri | Comparative Example |
| 204 | $Al_{90}Pd_2Co_8$ | 425 | 430 | Bri | Comparative Example |
| 205 | $Al_{98.5}Pd_{0.5}Co_1$ | 290 | 95 | Duc | Comparative Example |
| 206 | $Al_{85}Pd_{11}Co_4$ | 460 | 465 | Bri | Comparative Example |
| 207 | $Al_{94.5}Pd_{0.5}Cu_5$ | 340 | 105 | Duc | Comparative Example |
| 208 | $Al_{88}Pd_{11}Cu_1$ | 475 | 435 | Bri | Comparative Example |
| 209 | $Al_{89}Pd_3Cu_8$ | 490 | 410 | Bri | Comparative Example |
| 210 | $Al_{98}Pd_1Cu_1$ | 410 | 95 | Duc | Comparative Example |
| 211 | $Al_{85}Pd_{12}Cu_3$ | 550 | 420 | Bri | Comparative Example |

It is clear from the results shown in Tables 2 and 3 that an aluminum-based alloy possessing a high bearing force and hardness, which endured bending and could undergo processing, was obtainable when the alloy comprising at least one of Mn, Fe, Co, Ni, and Cu, as element M, in addition to an Al—V, Al—Mo, Al—W, Al—Fe, Al—Nb, or Al—Pd two-component alloy has the atomic percentages satisfying the relationships $Al_{balance}Q_aM_b$, $1 \leqq a \leqq 8$, $0<b<5$, $3 \leqq a+b \leqq 8$, Q=V, Mo, Fe, W, Nb, and/or Pd, and M=Mn, Fe, Co, Ni, and/or Cu, wherein the difference in the atomic radii between Q and M exceeds 0.01 Å and the alloy does not contain rare-earths.

In contrast to normal aluminum-based alloys which possess an Hv of approximately 50 to 100 DPN, the samples according to the present invention, shown in Table 2, display an extremely high hardness from 295 to 375 DPN.

In addition, in regards to the tensile rupture strength ($\sigma_f$), normal age hardened type aluminum-based alloys (Al—Si—Fe type) possess values from 200 to 600 MPa; however, the samples according to the present invention have clearly superior values in the range from 630 to 1350 MPa.

Furthermore, when considering that the tensile strengths of aluminum-based alloys of the AA6000 series (alloy name according to the Aluminum Association (U.S.A.)) and AA7000 series which lie in the range from 250 to 300 MPa, Fe-type structural steel sheets which possess a value of approximately 400 MPa, and high tensile strength steel sheets of Fe-type which range from 800 to 980 MPa, it is clear that the aluminum-based alloys according to the present invention display superior values.

(X-ray Diffraction)

Figure 2:
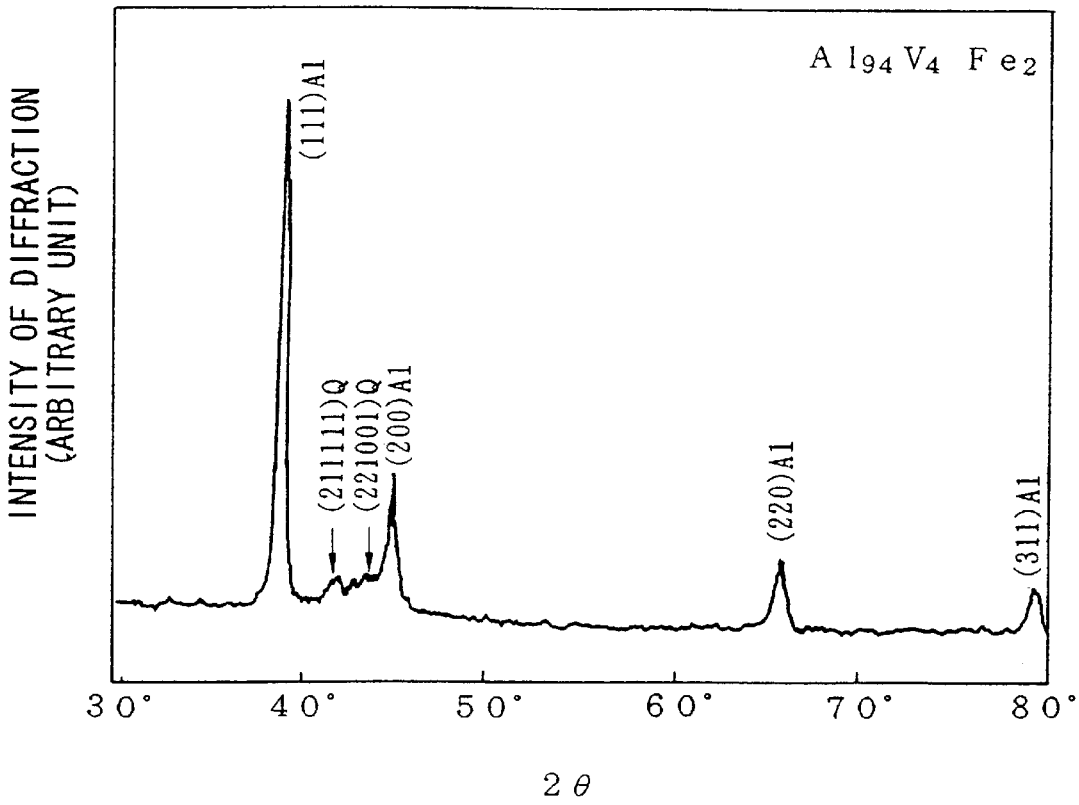
FIG. 2 shows the analysis result of the X-ray diffraction of an alloy having the composition of $Al_{94}V_4Fe_2$.
Figure 3:
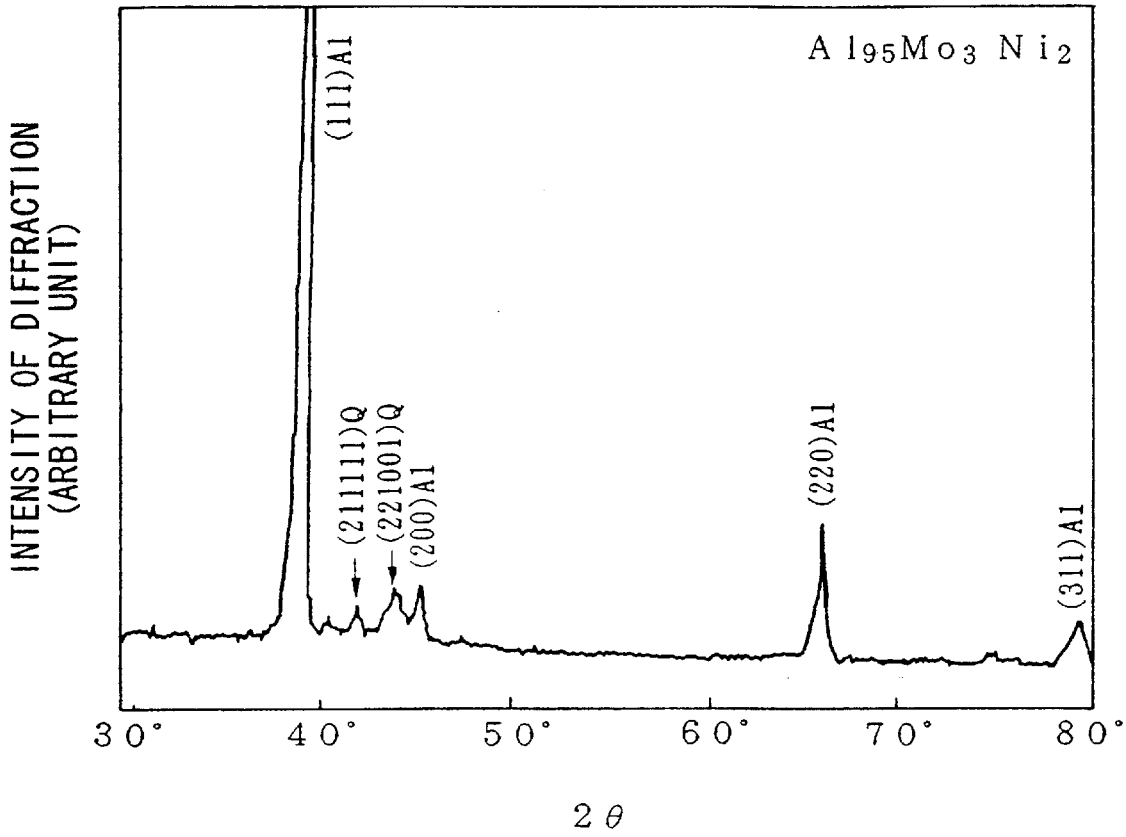
FIG. 3 shows the analysis result of the X-ray diffraction of an alloy having the composition of $Al_{95}Mo_3Ni_2$.

FIG. 2 shows an X-ray diffraction pattern possessed by an alloy sample having the composition of $Al_{94}V_4Fe_2$. FIG. 3 shows an X-ray diffraction pattern possessed by an alloy sample having the composition of $Al_{95}Mo_3Ni_2$. According to these patterns, each of these three alloy samples has a multiphase structure comprising a fine Al-crystalline phase having an fcc structure and a fine regular-icosahedral quasi-crystalline phase. In these patterns, peaks expressed as (111), (200), (220), and (311) are crystalline peaks of Al having an fcc structure, while peaks expressed as (211111) and (221001) are dull peaks of regular-icosahedral quasi crystals.

(Crystallization Temperature Measurement)

Figure 4:
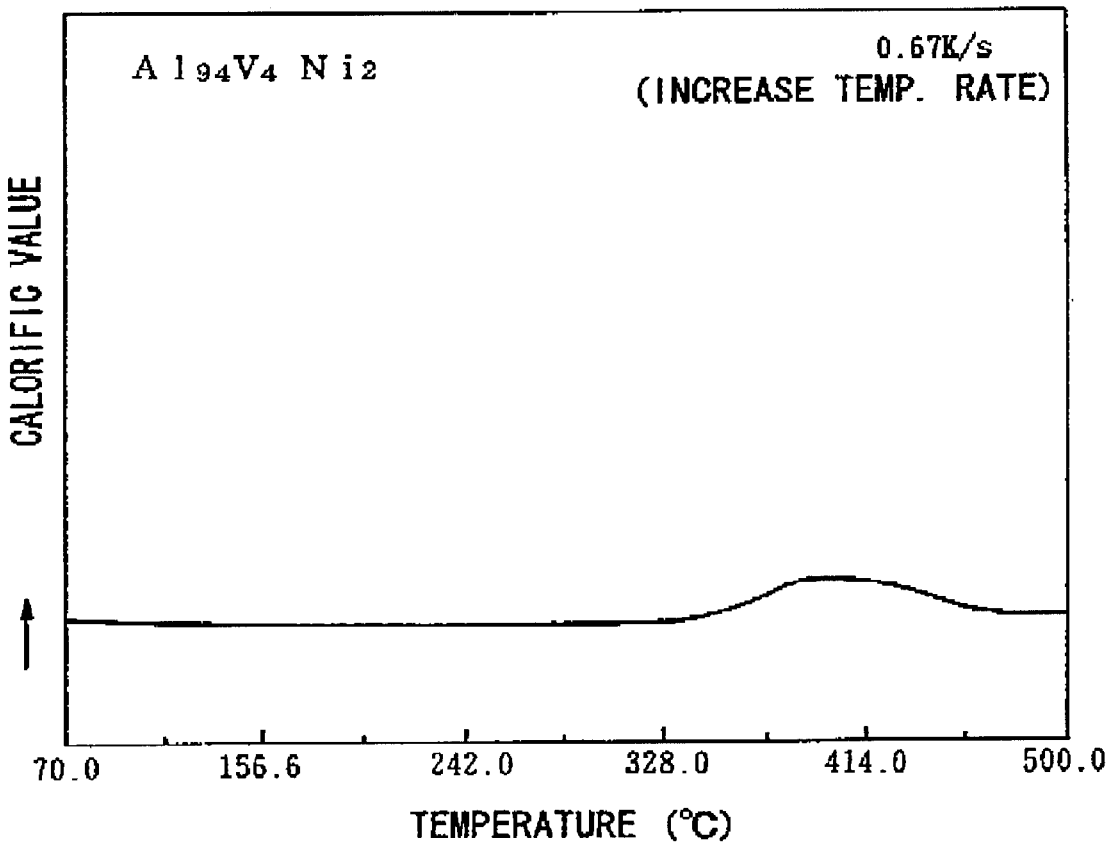
FIG. 4 shows the thermal properties of an alloy having the composition of $Al_{94}V_4Ni_2$.
Figure 5:
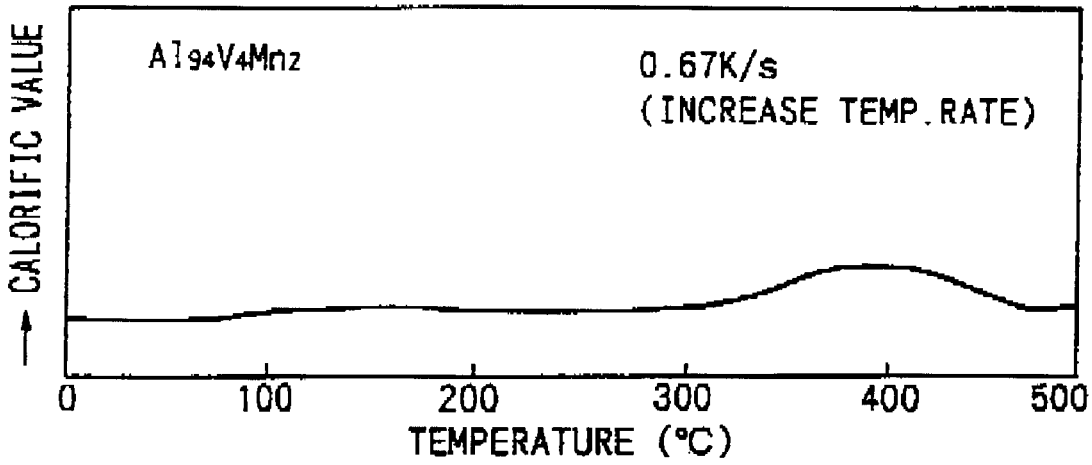
FIG. 5 shows the thermal properties of an alloy having the composition of $Al_{94}V_4Mn_2$.
Figure 6:
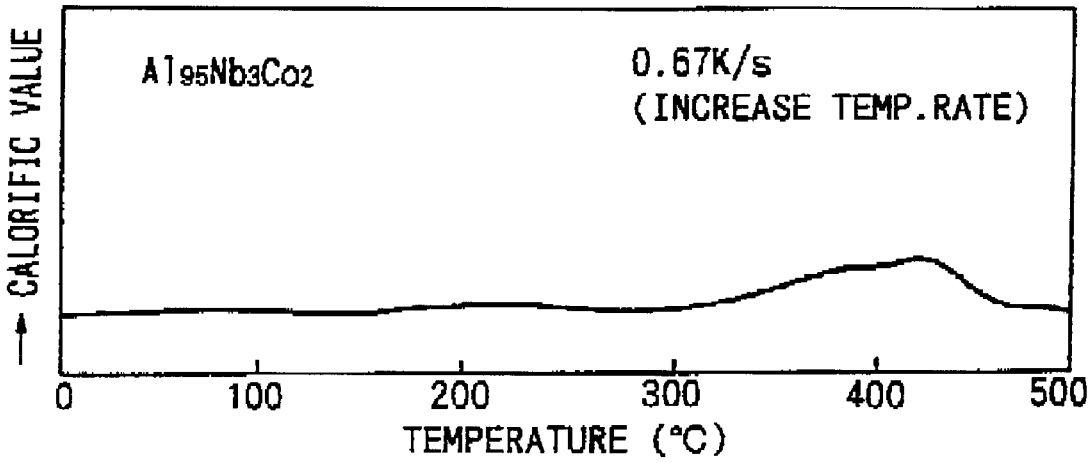
FIG. 6 shows the thermal properties of an alloy having the composition of $Al_{95}Nb_3Co_2$.
Figure 7:
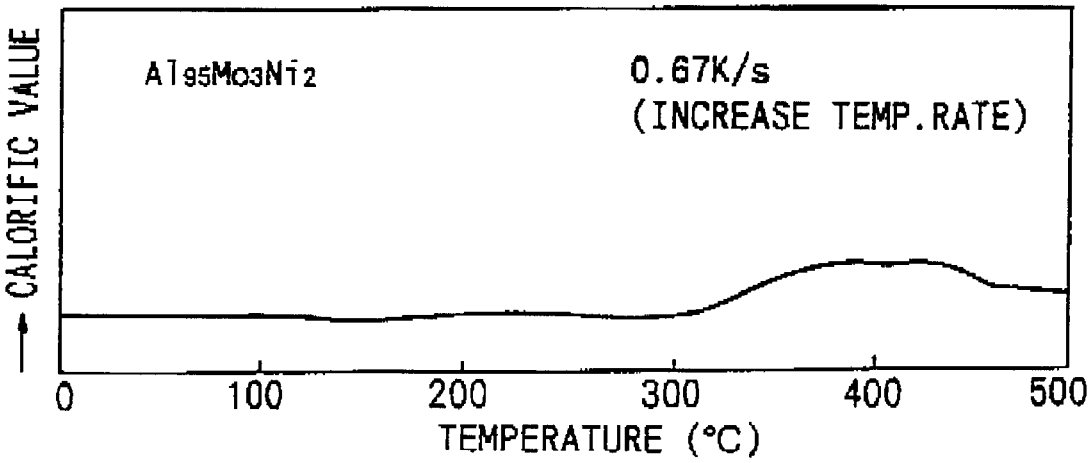
FIG. 7 shows the thermal properties of an alloy having the composition of $Al_{95}Mo_3Ni_2$.

FIG. 4 shows the DSC (Differential Scanning Calorimetry) curve in the case when an alloy having the composition of $Al_{94}V_4Ni_2$ is heated at rate of 0.67 K/s, FIG. 5 shows the same for $Al_{94}V_4Mn_2$, FIG. 6 shows the same for $Al_{95}Nb_3Co_2$, and FIG. 7 shows the same for $Al_{95}Mo_3Ni_2$. In these figures, a dull exothermal peak, which is obtained when a quasi-crystalline phase is changed to a stable crystalline phase, is seen in the high temperature region exceeding 300° C.

Figure 8:
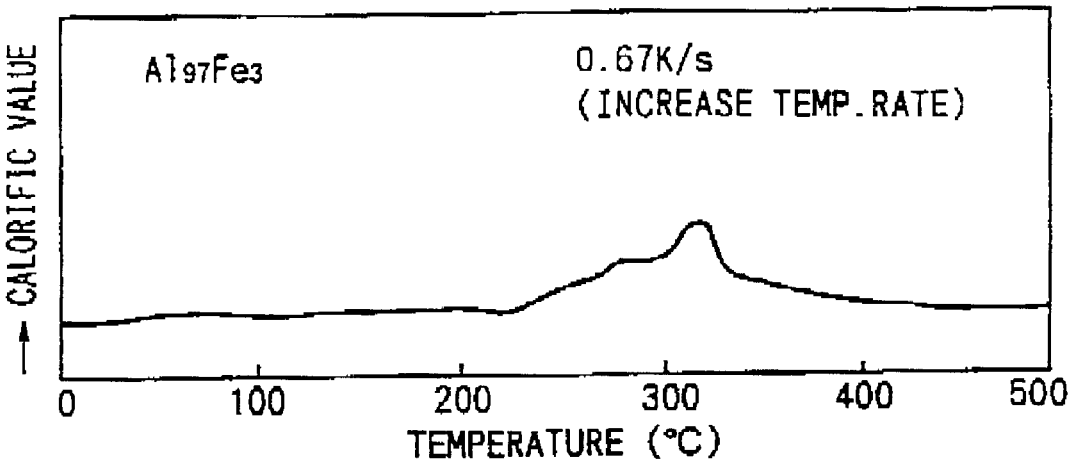
FIG. 8 shows the thermal properties of an alloy having the composition of $Al_{97}Fe_3$.
Figure 9:
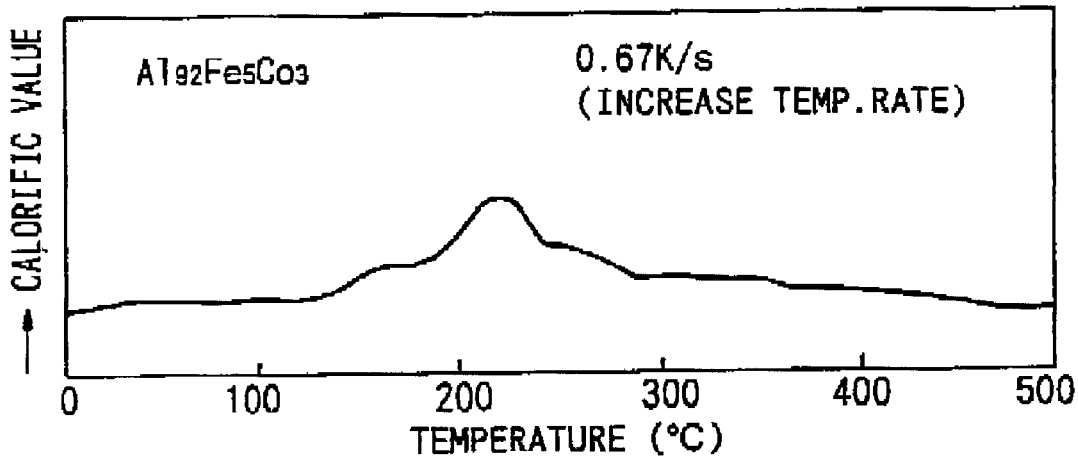
FIG. 9 shows the thermal properties of an alloy having the composition of $Al97Fe_5Co_3$.
Figure 10:
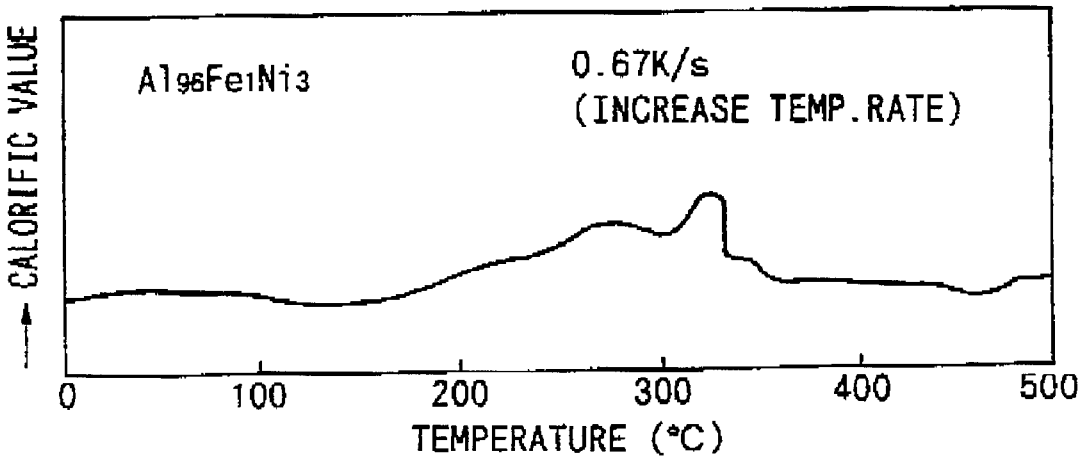
FIG. 10 shows the thermal properties of an alloy having the composition of $Al_{97}Fe_1Ni_3$.

FIG. 8 shows the DSC curve in the case when an alloy having the composition of $Al_{97}Fe_3$ is heated at a rate of 0.67 K/s, FIG. 9 shows the same for $Al_{92}Fe_5Co_3$, and FIG. 10 shows the same for $Al_{96}Fe_1Ni_3$, each of which has an atomic radius difference between Q and M or 0.01 Å or less. In the DSC curves of these samples, the crystallization temperature which is indicated by the temperature at the starting end of the exothermal peak is each 300° C. or less, which is comparatively low in comparison to the results of FIGS. 4–7, thereby suggesting that thermodynamically stable intermetallic compounds are formed.

(Charpy Impact Values)

Alloy samples having the compositions indicated below were prepared, and their Charpy impact values were measured. That is, after preparing a rapidly hardened powder by means of high-pressure atomization, a powder having a grain size of 25 $\mu$m or less was separated out, filled into a copper container and formed into a billet, then bulk samples were made using a 100-ton warm press with a cross-sectional reduction rate of 80%, a push-out greed of 5 mm/s and a push-out temperature of 573 K. Using these bulk samples, a Charpy impact test was performed. The results are shown in Table 4.

TABLE 4

| Composition | Units: kgf-m/cm$^2$ Charpy Impact Value |
|---|---|
| $Al_{94}V_4Mn_2$ | 1.2 |
| $Al_{95}Nb_3Co_2$ | 1.1 |
| $Al_{95}Mo_3Ni_2$ | 1.2 |
| $Al_{95}W_4Cu_1$ | 1.2 |
| $Al_{93}V_5Fe_2$ | 1 |
| $Al_{95}Nb_3Cu_2$ | 1.5 |
| $Al_{93}V_4Ni_2$ | 1.2 |
| $Al_{93}Mo_4Cu_3$ | 1.2 |
| $Al_{93}W_5Mn_2$ | 1 |
| $Al_{92}Nb_4Ni_4$ | 1.5 |
| $Al_{97}Fe_3$ | 0.3 |
| $Al_{92}Fe_5Co_3$ | 0.2 |
| $Al_{96}Fe_1Ni_3$ | 0.3 |

According to the results of Table 4, $Al_{97}Fe_3$, $Al_{92}Fe_5Co_3$ and $Al_{96}Fe_1Ni_3$ wherein the atomic radius difference between Q and M is less than 0.01 Å all have Charpy impact values of less than 1, while $Al_{94}V_4Mn_2$, $Al_{95}Nb_3Co_2$, $Al_{95}Mo_3Ni_2$, $Al_{95}W_4Cu_1$, $Al_{93}V_5Fe_2$, $Al_{95}Nb_3Cu_2$, $Al_{93}V_4Ni_2$, $Al_{93}Mo_4Cu_3$, $Al_{93}W_5Mn_2$ and $Al_{92}Nb_4Ni_4$ wherein the atomic radius difference between Q and M is greater than 0.01 Å all have Charpy impact values greater than 1, which is a level suitable for practical applications.

Although the invention has been described in detail herein with reference to its preferred embodiments and certain described alternatives, it is to be understood that this description is by way of example only, and it is not to be construed in a limiting sense. It is further understood that numerous changes in the details of the embodiments of the invention, and additional embodiments of the invention, will be apparent to, and may be made by persons of ordinary skill in the art having reference to this description. It is contemplated that all such changes and additional embodiments are within the spirit and true scope of the invention as claimed below.

What is claimed is:

1. A production method for an aluminum-based alloy comprising the steps of:

a) selecting an element Q, which is at least one element selected from the group consisting of V, Mo, Fe, W, Nb, and Pd;

b) selecting an element M, which is at least one element having an atomic radius which is more than 0.01 Å larger or smaller than the atomic radius of said element Q and which is selected from the group consisting of Mn, Fe, Co, Ni, and Cu;

c) preparing a liquid-melt consisting essentially of Al having an amount in atomic percentage of 100–(a+b), said element Q having an amount in atomic percentage of a and said element M having an amount in atomic percentage of b, wherein said a and b satisfy the relationships $1 \leqq a \leqq 8$, $0<b<5$, and $3 \leqq a+b \leqq 8$, said liquid-melt not containing rare earth elements; and d) quick-quenching said liquid-melt to obtain a solidified aluminum-based alloy having a metallographic structure incorporating a quasi-crystalline phase.

2. A production method for an aluminum-based alloy according to claim 1, wherein said solidified aluminum-based alloy has a metallographic structure incorporating a quasi-crystalline phase.

3. A production method for an aluminum-based alloy according to claim 1, wherein said step d) further comprises the steps of:

e) pouring said liquid-melt onto a rotating roll; and f) quick-quenching said liquid-melt to form a thin layer of the aluminum-based alloy.

4. A production method for an aluminum-based alloy according to claim 1, wherein said step d) further comprises the steps of:

g) atomizing said liquid-melt; and h) quick-quenching said liquid-melt to form a powder of the aluminum-based alloy.

5. A production method for an aluminum-based alloy according to claim 1, wherein said step d) further comprises the steps of:

g) spraying said liquid-melt; and h) quick-quenching said liquid-melt to form a powder of the aluminum-based alloy.

* * * * *

UNITED STATES PATENT AND TRADEMARK OFFICE

CERTIFICATE OF CORRECTION

PATENT NO. : 6,331,218 B1
DATED : December 18, 2001
INVENTOR(S) : Akihisa Inoue et al.

It is certified that error appears in the above-identified patent and that said Letters Patent is hereby corrected as shown below:

Title page,
Item [73], Assignee, please correct as follows:
Replace "[73] Assignees: Tsuyoshi Masumoto; Akihisa Inoue, both of Tokyo (JP)" with -- [73] Assignees: Tsuyoshi Masumoto; Akihisa Inoue; and Yamaha Corporation all of Japan. --

Signed and Sealed this

Twenty-second Day of October, 2002

*Attest:*

*Attesting Officer*

JAMES E. ROGAN
*Director of the United States Patent and Trademark Office*